US006306342B2

(12) United States Patent
Koch et al.

(10) Patent No.: US 6,306,342 B2
(45) Date of Patent: Oct. 23, 2001

(54) ALUMINUM CASTING ALLOY

(75) Inventors: Hubert Koch, Rheinfelden; Horst Schramm, Loerrach; Peter Krug, Schopfheim, all of (DE)

(73) Assignee: Aluminium Rheinfelden GmbH (DE)

( * ) Notice: Subject to any disclaimer, the term of this patent is extended or adjusted under 35 U.S.C. 154(b) by 0 days.

(21) Appl. No.: 09/764,758

(22) Filed: Jan. 18, 2001

(30) Foreign Application Priority Data

Jan. 19, 2000 (EP) ..... 00810040

(51) Int. Cl.[7] ..... C22C 21/06

(52) U.S. Cl. ..... 420/543; 420/545; 420/547; 420/553

(58) Field of Search ..... 420/543, 545, 420/547, 553

(56) References Cited

U.S. PATENT DOCUMENTS

| | | | |
|---|---|---|---|
| 4,673,551 | | 6/1987 | Sugiyama et al. . |
| 5,573,606 | * | 11/1996 | Evans et al. ..... 148/440 |

FOREIGN PATENT DOCUMENTS

| | | | |
|---|---|---|---|
| 0 908 527 | | 4/1999 | (EP) . |
| 0 911 420 | | 4/1999 | (EP) . |
| 2552111-A1 | * | 3/1985 | (FR) . |
| 40-016888-A | * | 8/1965 | (JP) . |
| 53-137810-A | * | 12/1978 | (JP) . |
| 10-046280-A | * | 2/1998 | (JP) . |

* cited by examiner

*Primary Examiner*—George Wyszomierski
*Assistant Examiner*—Janelle Combs-Morillo
(74) *Attorney, Agent, or Firm*—Bachman & LaPointe, P.C.

(57) ABSTRACT

An aluminum casting alloy contains

| | |
|---|---|
| 0.5 to 2.0 | w. % magnesium |
| max. 0.15 | w. % silicon |
| 0.5 to 2.0 | w. % manganese |
| max. 0.7 | w. % iron |
| max. 0.1 | w. % copper |
| max. 0.1 | w. % zinc |
| max. 0.2 | w. % titanium |
| 0.1 to 0.6 | w. % cobalt |
| max. 0.8 | w. % cerium |
| 0.5 to 0.5 | w. % zirconium |
| max. 1.1 | w. % chromium |
| max. 1.1 | w. % nickel |
| 0.005 to 0.15 | w. % vanadium |
| max. 0.5 | w. % hafnium |

and aluminum as the remainder with further contaminants individually at 0.05 w. %, total max. 0.02 w. %.

The aluminum casting alloy is particularly suitable for diecasting and thixocasting or thixoforging. One particular application is diecasting for components with high requirements for mechanical properties as these are already present in the casting state and thus no further heat treatment is required.

19 Claims, No Drawings

ALUMINUM CASTING ALLOY

BACKGROUND OF THE INVENTION

The invention concerns an aluminium casting alloy, in particular an aluminum diecasting alloy.

Diecasting technology has today developed to the point where it is possible to produce castings to high quality standards. The quality of a diecasting, however, depends not only on the machine setting and the process selected, but largely also on the chemical composition and structure of the casting alloy used. The latter two parameters are known to affect the castability, the feed behavior (G. Schindelbauer, J. Czikel "Mould Filling Capacity and Volume Deficit of Conventional Aluminium Diecasting Alloys", Giesserieforschung (Foundry Research) 42, 1990, page 88/89), the mechanical properties and—of particular importance in diecasting—the life of the casting tools (L. A. Norström, B. Klarenfjord, M. Svenson "General Aspects on Wash-out Mechanisms in Aluminium Diecasting Dies", 17th International NADCA Diecasting Congress 1993, Cleveland Ohio).

In the past, little attention has been paid to the development of alloys which are particularly suitable for diecasting high quality castings. Efforts were mostly concentrated on the refinement of the diecasting process technology. Manufacturers in the automotive industry, however, are increasingly demanding the provision of weldable components of high ductility in the diecasting process, and with high production numbers diecasting is the most economic production method.

Due to the refinement of diecasting technology it is possible today to produce weldable and heat treatable castings of high quality. This has expanded the area of application for diecasting components to include safety-relevant components. For such components normally AlSiMg alloys are today used, as these have good castability with low mold wear. In order to be able to achieve the required mechanical properties, in particular the high elongation at rupture, the casting must be subjected to heat treatment. This heat treatment is required to form the casting phase and thus achieve a tough rupture behavior. Heat treatment normally means solution heat treatment at temperatures just below the solidus temperature, with subsequent quenching in water or another medium at temperatures <100° C. The material treated in this way only has a low elongation limit and tensile strength. In order to raise these properties to the required value, artificial ageing is then performed. This can also be process-related, e.g. by heat application during painting or stress-relief annealing of a complete component assembly.

As diecastings are cast close to the final dimensions, they usually have a complex geometry with thin walls. During solution heat treatment, and in particular in the quenching process, distortion must be expected which can require retouching, e.g. by straightening the casting, or in the worst case can lead to rejection. Solution heat treatment also incurs additional costs, and the economic efficiency of this production could be improved substantially if alloys were available which fulfilled the required properties without heat treatment.

AlMg alloys are also known which are characterized by high ductility. Such an alloy is disclosed for example in U.S. Pat. No. 5,573,606. However, these alloys have the disadvantage of high mold wear and cause problems on removal from the mold, which reduces productivity considerably.

SUMMARY OF THE INVENTION

The present invention is therefore based on the task of producing a diecasting alloy of high elongation at rupture with still acceptable elongation limits, which has good castability and adheres little to the mold. The following minimum values must be achieved in the casting state:

Elongation (A5): 14% Elongation limit (Rp 0.2): 100 MPa

The alloy must also be weldable, have a high corrosion resistance, and in particular have no susceptibility to stress crack corrosion.

The solution according to the invention leads to an alloy consisting of:

| | |
|---|---|
| 0.5 to 2.0 | w. % magnesium |
| max. 0.3 | w. % silicon |
| 0.5 to 2.0 | w. % manganese |
| max. 0.7 | w. % iron |
| max. 0.1 | w. % copper |
| max. 0.1 | w. % zinc |
| max. 0.2 | w. % titanium |
| 0.1 to 0.6 | w. % cobalt |
| max. 0.8 | w. % cerium |
| 0.5 to 0.5 | w. % zirconium |
| max. 1.1 | w. % chromium |
| max. 1.1 | w. % nickel |
| 0.005 to 0.15 | w. % vanadium |
| max. 0.5 | w. % hafnium |

with aluminum as the remainder with further contaminants individually max. 0.05 w. %, total max. 0.2 w. %. The purity of aluminum used to produce the casting corresponds to primary aluminum of quality Al 99.8 H.

DETAILED DESCRIPTION OF PREFERRED EMBODIMENTS

Today, the laser welding process is used more and more for welding. In this process a high temperature is generated in a relatively small area so that low-melting elements must be minimized in this casting alloy in order to keep the generation of metal vapor, and hence increased porosity, to a minimum. The alloy according to the invention may not therefore contain beryllium.

Furthermore, according to the invention it is a framework condition that the alloy content be kept close to that of wrought alloy groups so that on later recycling of alloys, used for example in vehicle construction, a reusable alloy system is obtained, or the mixing inherent in an increase in entropy remains within limits.

The alloy according to the invention in the casting state has a well formed α-phase. The eutectic, mainly of $Al_6$(Mn, Fe)-phases, is very fine in structure and therefore leads to a highly ductile rupture behavior. The proportion of manganese prevents mold-adhesion and guarantees good removal from the mold. The magnesium content, in connection with manganese, gives the casting a high dimensional rigidity so that even on mold removal, very little or no distortion is expected.

Because of the α-phase already formed, this alloy can also be used for thixocasting or thixoforging. The α-phase forms immediately on remelting so the thixotropic properties are excellent. At conventional heating rates, a grain size of <100 μm is generated.

To achieve a high ductility it is of essential importance that the iron content in the alloy is restricted. Surprisingly, it has been found that despite the low iron content, the alloy composition according to the invention has no tendency to stick in the mold. In contrast to the general view that mold adhesion can be prevented in all cases with high iron contents of more than 0.2 w. %, with the alloy type proposed according to the invention it has been found that increasing the iron content to over 0.7 w. % already causes an increase in adhesion tendency.

For the individual alloy elements the following content ranges are preferred:

| | |
|---|---|
| silicon | max. 0.15 w. % |
| magnesium | 0.60 to 1.2 w. % |
| manganese | 0.8 to 1.6 w. % |
| | in particular at least 1.1 w. % |
| cobalt | 0.3 to 0.6 w. % |
| vanadium | 0.01 to 0.03 w. % |
| zirconium | 0.08 to 0.35 w. % |

Zirconium increases the elongation limit and generates a finer grain so that the required mechanical properties are achieved, in particular the elongation limit in the casting state.

The tendency of the casting to stick in the mold can be further drastically reduced, and the mold removal behavior essentially improved, if in addition to manganese a cobalt and/or cerium is also added. Preferably, the alloy therefore contains 0.3 to 0.6 w. % cobalt and/or 0.05 to 0.8 w. %, in particular 0.1 to 0.5 w. %, cerium. An optimum effect is then achieved if the sum of the contents of cobalt, cerium and manganese in the alloy amounts to at least 1.4 w. % and the alloy contains at least 1.1 w. % manganese.

The alloy contains 0.005 to 0.15 w. %, in particular 0.01 to 0.03 w. %, vanadium to improve the castability or flow behavior. Tests have shown that the mold filling capacity is substantially improved by the addition of vanadium. Vanadium also prevents the scabbing tendency known with AlMg alloys, in particular since no beryllium is added to the alloy. A content of max. 0.2 w. % titanium, in particular 0.1 to 0.18 w. % titanium, causes an additional grain refinement. The content of titanium is limited to max. 0.2 w. % in order not to affect adversely the ductility of the alloy. A content of max. 0.5 w. %, preferably 0.1 to 0.4 w. %, in particular 0.2 to 0.35 w. % hafnium, increases the elongation limit without adversely affecting the ductility. To achieve higher elongation limits the alloy can also contain max. 1.1 w. % chromium, in particular 0.2 to 1.1 w. % chromium, and 1.1 w. % nickel, in particular 0.3 to 1.1 w. % nickel. Chromium and nickel, or a combination of the two, increases the elongation limit without affecting the ductility, in particular if the sum of the contents of nickel and chromium is at least 0.3 w. %. In addition the two elements increase the corrosion resistance of the alloy.

The aluminum casting alloy according to the invention is particularly suitable for thixocasting or thixoforging.

Although the aluminum casting alloy according to the invention is intended in particular for processing in diecasting, it can evidently also be cast with other processes e.g.

sand casting gravity diecasting low pressure casting thixocasting/thixoforging squeeze casting.

The greatest advantages, however, arise in casting processes which proceed at a high cooling rate such as for example the diecasting process.

From the constitution of the alloy it can be gathered that, as already cited, in comparison with conventional casting alloys the content of alloy elements is kept relatively low. This leads to a lack of susceptibility to heat cracking. Whereas alloys with more than 3 w. % magnesium, which become very soft in the solid/liquid range, have a tendency to heat cracking because of the wide setting interval and the shrinkage forces exceeding the strength, this does not occur for the present alloy. Due to the smaller melt interval, this temperature range is passed relatively quickly and thus the tendency to heat cracking is minimized.

Further advantages, features and details of the aluminum casting alloy according to the invention, and its excellent properties, arise from the following description of preferred design examples.

EXAMPLES

From seven different alloys, on a diecasting machine with 400 t closing force per alloy, pots were cast with a wall thickness of 3 mm and dimensions 120×120×60 mm. Test rods for tensile tests were taken from the sides, and the mechanical properties of these were measured in the casting state. The results are summarized in the table below. Here Rp0.2 indicates the elongation limit, Rm the tensile strength and A5 the elongation at rupture. The measurement values given are mean values of ten individual measurements. The alloys were melted on a base of primary aluminum of quality Al 99.8H.

The tests show that the minimum values required with regard to elongation limit and elongation at break in the casting state are achieved with the aluminum casting alloy according to the invention.

The alloy is highly weldable, has excellent casting behavior, a practically negligible adhesion tendency and can be easily removed from the mold.

| | Alloy 1 | Alloy 2 | Alloy 3 | Alloy 4 | Alloy 5 | Alloy 6 | Alloy 7 |
|---|---|---|---|---|---|---|---|
| Si[w. %] | 0.05 | 0.045 | 0.036 | 0.08 | 0.035 | 0.045 | 0.12 |
| Fe[w. %] | 0.10 | 0.38 | 0.23 | 0.24 | 0.23 | 0.10 | 0.30 |
| Mn[w. %] | 1.40 | 1.42 | 1.43 | 1.19 | 1.62 | 1.48 | 1.35 |
| Mg[w. %] | 0.83 | 0.98 | 1.00 | 1.15 | 1.102 | 0.89 | 1.22 |
| Ce[w. %] | — | — | — | — | — | 0.35 | 0.15 |
| Co[w. %] | 0.35 | 0.35 | 0.35 | 0.35 | 0.35 | 0.25 | 0.24 |
| Hf[w. %] | 0.13 | — | 0.32 | — | — | — | — |
| V[w. %] | 0.006 | 0.01 | 0.02 | 0.025 | 0.025 | 0.025 | 0.06 |
| Zr[w. %] | 0.16 | 0.20 | 0.22 | 0.21 | 0.23 | 0.23 | 0.25 |
| $R_{p0.2}$[N/mm$^2$] | 110 | 115 | 117 | 115 | 125 | 122 | 136 |
| Rm[N/mm$^2$] | 197 | 209 | 208 | 205 | 211 | 205 | 242 |
| $A_5$[%] | 19 | 15.5 | 17.4 | 16.8 | 14.1 | 15.6 | 19.6 |

What is claimed is:

1. Aluminum casting alloy, wherein the alloy consists of the following constituents in weight percents:

| | |
|---|---|
| 0.5 to 2.0 | % magnesium, |
| max. 0.3 | % silicon, |
| 0.5 to 2.0 | % manganese, |
| max. 0.7 | % iron, |
| max. 0.1 | % copper, |
| max. 0.1 | % zinc, |
| max. 0.2 | % titanium, |
| 0.1 to 0.6 | % cobalt, |
| max. 0.8 | % cerium, |
| 0.5 to 0.5 | % zirconium, |
| max. 1.1 | % chromium, |
| max. 1.1 | % nickel, |
| 0.005 to 0.15 | % vanadium, |
| max. 0.5 | % hafnium, |

and aluminum as the remainder with further contaminants individually max. 0.05 weight %, total max. 0.2 weight %.

2. Aluminum casting alloy according to claim 1, as an aluminum diecasting alloy.

3. Aluminum casting alloy according to claim 1, wherein the alloy contains max. 0.15 weight % silicon.

4. Aluminum casting alloy according to claim 1, wherein the alloy contains 0.6 to 1.2 weight % magnesium.

5. Aluminum casting alloy according to claim 1, wherein the alloy contains 0.8 to 1.6 weight % manganese.

6. Aluminum casting alloy according to claim 1, wherein the alloy contains max. 0.3 weight % iron.

7. Aluminum casting alloy according to claim 1, wherein the alloy contains max. 0.3 to 0.6 weight % cobalt.

8. Aluminum casting alloy according to claim 1, wherein the alloy contains max. 0.05 to 0.8 weight % cerium.

9. Aluminum casting alloy according to claim 8, wherein the alloy contains max. 0.1 to 0.5 weight % cerium.

10. Aluminum casting alloy according to claim 7, wherein the sum of the contents of cobalt, cerium and manganese in the alloy amounts to at least 1.4 weight % and the alloy contains at least 1.1 weight % manganese.

11. Aluminum casting alloy according to claim 1, wherein the alloy contains 0.2 to 1.1 weight % chromium.

12. Aluminum casting alloy according to claim 1, wherein the alloy contains 0.3 to 1.1 weight % nickel.

13. Aluminum casting alloy according to claim 11, wherein the sum of the contents of nickel and chromium is at least 0.3 weight %.

14. Aluminum casting alloy according to claim 1, wherein the alloy contains 0.08 to 0.35 weight % zirconium.

15. Aluminum casting alloy according to claim 1, wherein the alloy contains 0.01 to 0.03 weight % vanadium.

16. Aluminum casting alloy according to claim 1, wherein the alloy contains 0.1 to 0.4 weight % hafnium.

17. Aluminum casting alloy according to claim 16, wherein the alloy contains 0.2 to 0.35 weight % hafnium.

18. Aluminum casting alloy according to claim 1, wherein the alloy as a diecasting alloy in the casting state has an elongation limit (Rp0.2) of min. 100 MPa and an elongation at break (A5) of at least 14%.

19. An aluminum alloy wherein the alloy consists of the following constituents in weight percents:

| | |
|---|---|
| 0.5 to 2.0 | % magnesium, |
| max. 0.3 | % silicon, |
| 0.5 to 2.0 | % manganese, |
| max. 0.7 | % iron, |
| max. 0.1 | % copper, |
| max. 0.1 | % zinc, |
| max. 0.2 | % titanium, |
| 0.1 to 0.6 | % cobalt, |
| max. 0.8 | % cerium, |
| 0.5 to 0.5 | % zirconium, |
| max. 1.1 | % chromium, |
| max. 1.1 | % nickel, |
| 0.005 to 0.15 | % vanadium, |
| max. 0.5 | % hafnium, |

and aluminum as the remainder with further contaminants individually max. 0.05 weight %, total max. 0.2 weight %, wherein said alloy is suitable for thixocasting or thixoforging.

* * * * *

UNITED STATES PATENT AND TRADEMARK OFFICE

CERTIFICATE OF CORRECTION

PATENT NO. : 6,306,342 B2
DATED : October 23, 2001
INVENTOR(S) : Hubert Koch et al.

It is certified that error appears in the above-identified patent and that said Letters Patent is hereby corrected as shown below:

Title page,
Item [57], ABSTRACT
Line 11, "0.5 to 0.5" should read -- 0.05 to 0.5 --.

Column 2,
Line 20, "0.5 to 0.5" should read -- 0.05 to 0.5 --.

Column 5,
Line 14, "0.5 to 0.5" should read -- 0.05 to 0.5 --.

Column 6,
Line 31, "0.5 to 0.5" should read -- 0.05 to 0.5 --.

Signed and Sealed this

Fourth Day of June, 2002

*Attest:*

*Attesting Officer*

JAMES E. ROGAN
*Director of the United States Patent and Trademark Office*